US006928257B2

(12) United States Patent
Ogiso et al.

(10) Patent No.: US 6,928,257 B2
(45) Date of Patent: Aug. 9, 2005

(54) IMAGE FORMING AND RECORDING APPARATUS WITH THREE PRESSURE MEMBERS

(75) Inventors: Toshio Ogiso, Hitachi (JP); Masaru Nakano, Tsukuba (JP); Hiromitsu Fukuda, Chiyoda (JP); Shigeru Obata, Ishioka (JP); Toru Hanashima, Hitachi (JP); Kazushige Oonishi, Hitachi (JP); Chikara Hiraoka, Hitachi (JP); Toru Ohashi, Hitachi (JP); Akira Shimizu, Hitachinaka (JP); Kazuo Kikuchi, Hitachi (JP); Shogo Matsumoto, Ushiku (JP); Shoji Ukei, Hitachi (JP); Katsuyoshi Onose, Hitachi (JP); Tsuyoshi Koyama, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 17 days.

(21) Appl. No.: 10/607,063

(22) Filed: Jun. 27, 2003

(65) Prior Publication Data

US 2004/0057759 A1 Mar. 25, 2004

(30) Foreign Application Priority Data

Jun. 28, 2002 (JP) ..... 2002-189022

(51) Int. Cl.[7] ..... G03G 15/20
(52) U.S. Cl. ..... 399/329

(58) Field of Search ..... 399/329, 328; 219/216

(56) References Cited

U.S. PATENT DOCUMENTS 5,483,331 A * 1/1996 Wayman et al. ..... 399/330
6,233,424 B1 * 5/2001 Mohri et al. ..... 399/320

FOREIGN PATENT DOCUMENTS

JP 8-166734 6/1996 ..... G06G/15/20
JP 2001-228731 8/2001 ..... G06G/15/20

* cited by examiner

*Primary Examiner*—Quana Grainger
(74) *Attorney, Agent, or Firm*—Antonelli, Terry, Stout & Kraus, LLP

(57) ABSTRACT

An image forming and recording apparatus, having a fixing apparatus for fixing unfixed toner image on a recording medium, wherein the fixing apparatus includes a fixing roller integrating a heater therein, an endless belt wound around the fixing roller, and three pressure members for pressing the endless belt onto the fixing roller. A pressure member located nearest to a side of entry of paper among the three pressure members is made up with a non-rotary type pressure member, and other two pressure members are made up with either one of a rotary type pressure member and the non-rotary type pressure member.

10 Claims, 8 Drawing Sheets

FIG.3

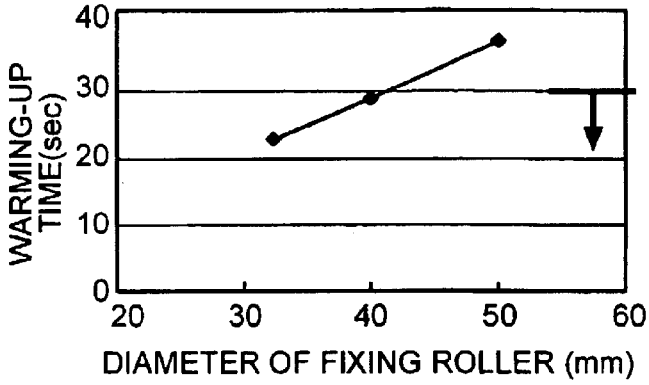

FIG.4

| ITEM | PAPER PREHEATING | TONER MELTING | TONER-PAPER FIXING | PAPER RELEASING |
|---|---|---|---|---|
| NIP WIDTH | ◎ | ◎ | ○ | △ |
| SURFACE PRESSURE | × | △ | ◎ | ◎ |
| PRESSURE LOADING | △ | ○ | ◎ | ○ |

ASSUMPTION ON CONTRIBUTION OF FUNCTIONS OF RESPECTIVE PRESSURE MEMBERS WHEN TESTING OF FIXING

| EXAMPLE OF FIXING VELOCITY 100 mm/sec | 1ST PRESSURE MEMBER (140N) | 2ND PRESSURE MEMBER (140N) |
|---|---|---|

| EXAMPLE OF FIXING VELOCITY 200 mm/sec | 1ST PRESSURE MEMBER (140N) | 2ND PRESSURE MEMBER (180N) | 3RD PRESSURE MEMBER (100N) |
|---|---|---|---|

FIG.5

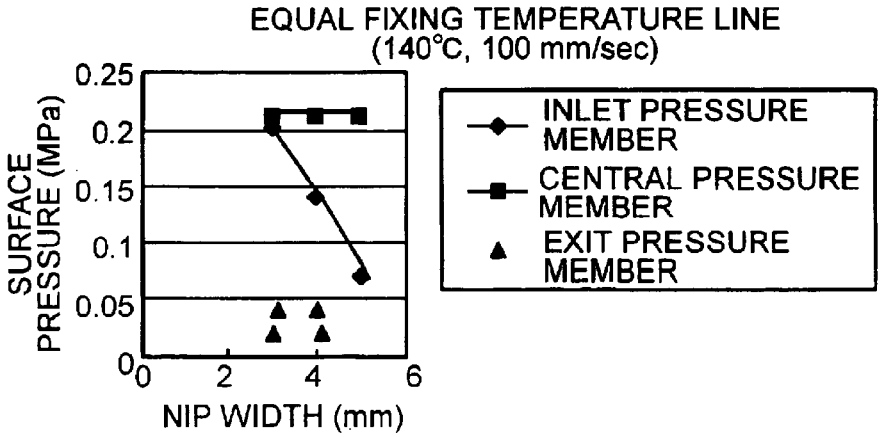

FIG.6
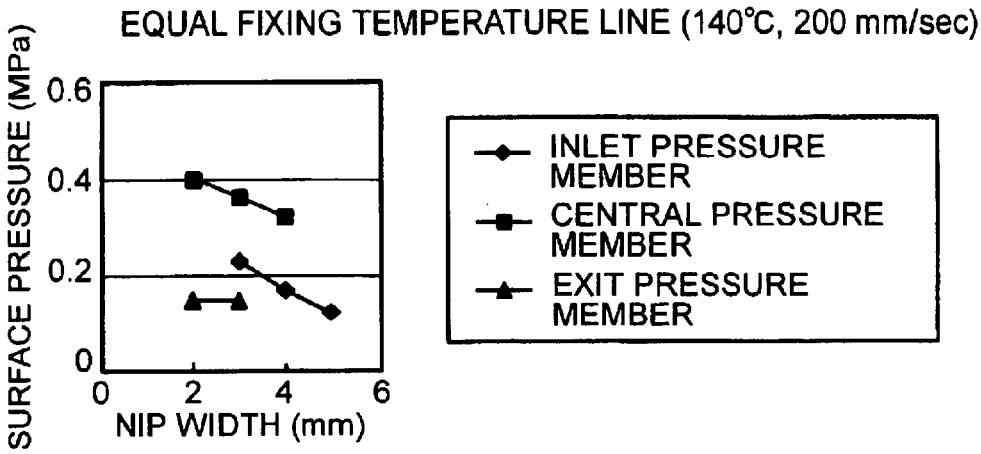
FIG.7
CONDITION OF PAPER RELEASE
| PRESSURE OF EXIT PRESSURE MEMBER | NORMAL PAPER 80g/m² | THIN PAPER 60g/m² |
|---|---|---|
| 0.05(Mpa) | × | × |
| 0.1(Mpa) | ○ | × |
| 0.15(Mpa) | ○ | △ |
| 0.2(Mpa) | ○ | ○ |
CONDITION: ADHERE AMOUNT OF TONER: 1.0mg/cm²
RELEASE CONDITION OF PAPER
| | |
|---|---|
| ○ | NO PROBLEM |
| △ | TIP BEND |
| × | JAM |
FIG.8
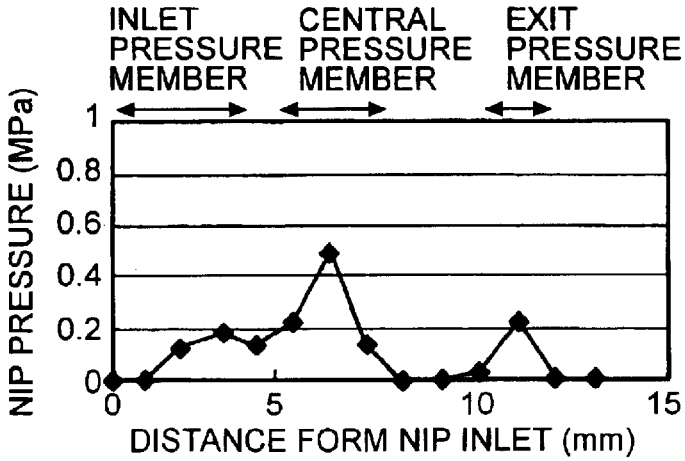

IMAGE FORMING AND RECORDING APPARATUS WITH THREE PRESSURE MEMBERS

BACKGROUND OF THE INVENTION

The present invention relates to an image forming and recording apparatus for printing characters and images on a recording medium, such as papers and OHP (Over-Head Projection) sheets or films, etc., and in particular, it relates to a fixing apparatus for fixing unfixed toner held on the recording medium.

As a fixing apparatus for achieving high-speed fixing, such as, being able to take a long time for heating and applying pressure on a recording medium, a pressure belt-type fixing apparatus is already known, wherein the recording medium is in contact with a fixing roller, in particular, on a surface of which the toner adheres, while being in contact with an endless belt, on a surface of which the toner does not adhere, and thereby pressing the recording medium by means of pressing members. In such the pressure belt-type fixing apparatus, it is very important to apply thermal energy and pressing energy appropriately, within a section where the fixing roller and the endless belt are in contact with, through which a paper passes, (hereinafter, being called by a "nip portion", and the width thereof is called by a "nip width").

In Japanese Patent Laying-Open No. Hei 8-166734 (1996) <JP-A 08-166734>, there is described a fixing apparatus for an image forming apparatus, comprising: a heat fixing roller integrating a heat generating means therein and being rotationally driven; a pressure belt being wound around the heat fixing roller, so as to be contact therewith; a pressure roller, being provided as one of a plural number of rollers for suspending the pressure belt, for pressing the heat fixing roller at a downstream portion of a pressure portion defined between the heat fixing roller and the pressure belt, in the rotating direction of the heat fixing roller, so that compress deformation is produced in an elastic layer of the heat fixing roller; and an auxiliary pressure roller, being provided in an upstream portion of the pressure portion, and being pressed onto the heat fixing roller through the pressure belt. In such the fixing apparatus, a total of pressure loading between the auxiliary pressure roller and the heat fixing roller, and pressure loading due to tension of the pressure belt, being wound around the heat fixing roller, so as to be contact therewith, are set to be equal to or greater than the pressure loading of the pressure roller. With this, the recording sheet can be transferred at velocity or speed near to the peripheral velocity of the heat fixing roller where no deformation is produced, by bringing the friction power prevail between the heat fixing roller and the recording sheet, in particular, between the pressure portion of the auxiliary pressure roller and the press portion of the pressure roller, i.e., a portion where a small distortion appears on the peripheral surface of the heat fixing roller.

Also, in Japanese Patent Laying-Open No. 2001-228731 (2001) <JP-A 2001-228731> is described a fixing apparatus, in which a pressure pad is used as a pressure member, and a porous resin member is provided opposing to the endless belt of the pressure members, for the purpose of lowering the friction, as well as, maintaining a stable traveling performance by preventing driving torque of the belt (i.e., the endless belt) from increasing due to variation with time, and wherein a lubricant is held within that porous resin member. With such the fixing apparatus, for the purpose of supplying the lubricant with stability, a felt is provided as a means for supplying the lubricant with stability, on an inner periphery surface of the endless belt.

In the fixing apparatus shown in the Japanese Patent Laying-Open No. Hei 8-166734, the pressure loading by means of the auxiliary pressure roller, the pressure loading caused due to tension of the pressure belt, and the pressure loading of the pressure roller are determined in amplitude thereof, by paying attention on a relationship between the peripheral velocity of the heat fixing roller and the transfer speed of the recording sheet, but it cannot be said that consideration is fully paid for distribution of operations or functions, such as, preheating of the recording medium at the nip portion, melting and fixing of toner, and strip of the recording sheet from the fixing roller, and/or distribution of the respective pressures at that time. Also, among the respective pressure loadings by means of the auxiliary pressure roll, due to tension of the pressure belt, and by the pressure roller, the pressure loading of the pressure roller is at the maximum.

BRIEF SUMMARY OF THE INVENTION

A first object, according to the present invention, is to provide an image forming and recording apparatus, for enabling a high-speed fixing and shortening of a first print time, as well as, achieving oil-less fixing.

Also, with the fixing apparatus disclosed in the Japanese Patent Laying-Open No. 2001-228731, however it is necessary to pay consideration for leakage of the lubricant from an end portion of the endless belt, due to the structure of pushing the felt for supplying the lubricant onto the inner peripheral surface of the endless belt, and therefore it has a drawback from a viewpoint of usability thereof.

Thus, a second object, according to the present invention, is to provide an image forming and recording apparatus, comprising a fixing apparatus being able to maintain a low driving torque of such the pressure belt-type fixing apparatus for a long time, cheap and superior in the usability thereof.

For accomplishing the object mentioned above, according to the present invention, there is provided an image forming and recording apparatus, having a fixing apparatus for fixing unfixed toner image on a recording medium, wherein said fixing apparatus comprises: a fixing roller integrating a heater therein; an endless belt wound around said fixing roller; and three (3) pressure members for pressing said endless belt onto said fixing roller, wherein second one from a side of entry of paper is made at maximum in pressure loading, among-said three (3) pressure members.

Alternatively, according to the present invention, there is provided an image forming and recording apparatus, having a fixing apparatus for fixing unfixed toner image on a recording medium, wherein said fixing apparatus comprises: a fixing roller integrating a heater therein; and an endless belt wound around said fixing roller, wherein pressure, being applied onto said fixing roller through said endless belt, has three (3) peaks, and pressure of a second peak from a side of entry of paper is larger than those of other two (2) peaks, among said three (3) peaks.

Also, for accomplishing the second object mentioned above, according to the present invention, there is further provided the image forming and recording apparatus, as defined in the above, wherein said fixing apparatus comprises a non-rotary pressure member, and a sheet-like member is inserted between said non-rotary pressure member and said endless belt, whereby letting said sheet-like member to hold lubricant therein.

In this case, it is preferable that, in the image forming and recording apparatus as defined in the above, a lubricant supply portion is provided at a portion of said sheet-like member, other than where said sheet-like member is put and pressed between said non-rotary type pressure member and said endless belt, whereby said lubricant supply portion has no contact with an inner peripheral surface of said belt.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein:

FIG. 3 is a graph for showing a relationship between diameter of a fixing roller of the fixing apparatus and a warming-up time, according to one embodiment of the present invention;

FIG. 4 shows functions by means of a nip portion in the fixing apparatus, according to one embodiment of the present invention;

FIG. 5 is a graph for showing a relationship between a pressure condition of the fixing apparatus and a fixing temperature, according to one embodiment of the present invention;

FIG. 6 is another graph for showing a relationship between a pressure condition of the fixing apparatus and a fixing temperature, according to one embodiment of the present invention;

FIG. 7 is shows releasing characteristics of a paper for use in the fixing apparatus, according to one embodiment of the present invention;

FIG. 8 is a graph for showing distribution of pressures of the fixing apparatus, in particular, at the nip portion in the fixing apparatus, according to one embodiment of the present invention;

DETAILED DESCRIPTION OF THE INVENTION

Hereinafter, explanation will be made on an embodiment of the image forming and recording apparatus according to the present invention.

Ordinarily, an image forming and recording apparatus, to which the present invention relates, has the following problems:

(A) In a color image forming and recording apparatus of making transcription of toner onto a paper by means of a single intermediate transcriptor, which can be constructed cheaply, a fixing speed is required, being four (4) times faster (indicated by a peripheral speed (mm/sec) of the fixing roller), comparing to that of the color image forming and recording apparatus, having the same speed for four (4) colors printings (indicated by page/minute), which has the intermediate transcriptor for each of the colors, therefore high-speed fixing must be achieved;

(B) For the purpose of shortening the time, starting from turn-on of an electric power source to the image forming and recording apparatus up to the time when a first printing starts (i.e., "a fist print time"), it is necessary to make small the thickness of a rubber layer on surface of the fixing roller having a large thermal capacity, however in such the case, it is necessary to apply a large heat and pressure onto toner, comparing to the case where the rubber thickness is thick; and (C) In an oil-less fixing method, where no oil supply is made on the surface of the fixing roller, for improving usability of the image forming and recording apparatus, since the toner impregnating wax therein is covered by a hard shell, therefore it is necessary to apply a large heat and pressure at the fixing portion.

Having studied on the pressure belt-type fixing method, satisfying all of the conditions (A) to (C) mentioned above, it comes to be clear that those cannot be achieved by the pressure means and pressure condition of the conventional art.

According to an embodiment, which will be explained hereinafter, it is possible to provide an image forming and recording apparatus having a fixing apparatus, achieving high-speed fixing, shortening the first print time, and obtaining the oil-less fixing, in particular, in a color image forming and recording apparatus, which conducts the transcription of toner onto a paper by means of a single intermediate transcriptor.

Explanation will be given on the one embodiment of the image forming and recording apparatus, according to the present invention, by referring to FIGS. 1 to 17.

Figure 1:
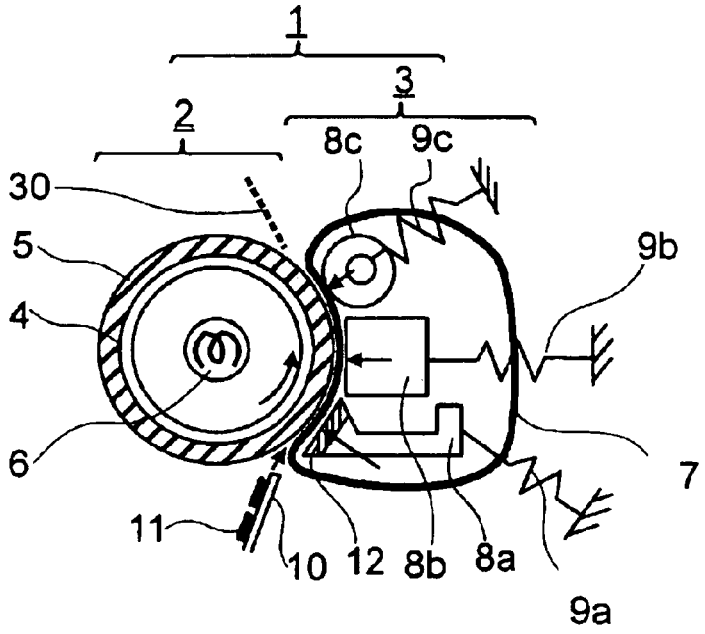
FIG. 1 is a view for showing the structure of a fixing apparatus of one embodiment of an image forming and recording apparatus, according to the present invention.
Figure 2:
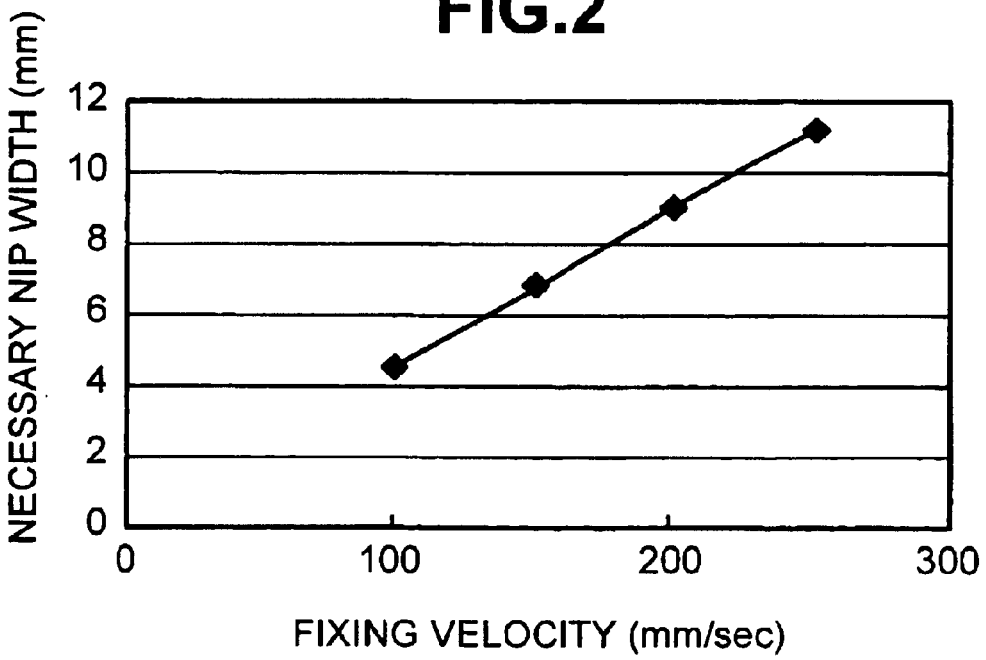
FIG. 2 shows a graph for showing a relationship between a fixing velocity and a necessary nip width, according one embodiment of the present invention.

The structure of the image forming and recording apparatus according to the present embodiment will be explained by referring to FIG. 1. A fixing apparatus is made up with a fixing roller 2 and a belt-pressing portion 3. The fixing roller 2 is made up with a core metal 4 of, such as, iron or aluminum, etc., and a rubber layer 5, and in an inside of which is integrated a heater 6. For increasing the releasing characteristics of toner, a layer may be formed on the surface of the rubber layer 5, which is made of fluorine resin. The belt-pressing portion 3 is made up with a belt pressing means 9, which is constructed by a belt 7, a belt-pressing member 8, a spring, etc. Hereinafter, a "nip portion" calls a portion, where the belt 7 is pressed onto the fixing roller 2, and the width thereof is called by "nip width". Pressure condition (pressure width, surface pressure) of the belt at the nip portion gives a large influence upon the performance of fixing. For obtaining the high-speed fixing, such as around 200 mm/sec, it is necessary to keep the nip width of about 9 mm, as is shown by the relationship between the fixing speed and the nip width in FIG. 2, and for applying appropriate surface pressure upon each of the nip portion, the pressing member 8 for applying pressure on the belt 7 is built up with three pieces of members 8*a*, 8*b* and 8*c*.

"Warming-up time" calls the time that is necessary to rise up temperature to a predetermined temperature, in the condition where the fixing apparatus is ready to print. For the purpose of shortening the warming-up time to be around 30 sec., it is preferable to bring the diameter of the fixing roller to be equal or less than 40 mm, as shown in FIG. 3. In a case of using oil-less toner, since it is hard (i.e., being high in the elasticity) comparing to the toner of a type, in which oil is supplied from an outside, it is necessary to apply pressure appropriately. For the purpose of keeping a wide nip width with a small diametric fixing roller, while applying an appropriate pressure, also it is required for the pressure member 8 to be constructed following the form of the fixing roller 2.

Functions with the nip portion of the pressure member are shown in FIG. 4. It has functions of paper preheating, toner melting, toner-paper fixing, and paper releasing, from an inlet of the nip portion, and contributions of the nip width, the surface pressure and the pressure loading to each of them are indicated, respectively. The pressure loading corresponds to the product between the nip width and the surface pressure.

Having studied on achievement of each pressure member to be simple in the construction thereof, by dividing the pressure member 8, such as, by means of a pressure pad, which has a flat plane on the surface thereof (the nip width 3–4 mm at maximum, for each pressure member), as is shown in FIG. 4, the fixing can be achieved by two (2) pieces of pressure members at the fixing velocity 100 mm/sec, however it comes to be apparent that three (3) pieces of pressure members are necessary at 200 mm/sec.

In the table, the pressure loading of each pressure member is put down with, under the condition that the fixing can be achieved, and also assumptions are put down with, up to which function(s) may be loaded by each the pressure member, judging from the pressure loading required for each function and the pressure loading, with which the fixing can be achieved. From this, it can be seen that functions of the fixing apparatus as a whole cannot be obtained unless increasing the number of the pressure members, which carries out the functions of the toner melting and the toner-paper fixing, in particular when the fixing velocity comes to be high.

From such the contribution of functions as shown below, in relation with values of the pressure loading for each pressure member when fixing at high speed, (center)>(inlet), (exit).

An inlet pressure member (paper pre-heating+a large part of toner melting): pressure loading (Δ+○, middle)

A central pressure member (a part of toner melting+a large part of the toner-paper fixing): pressure loading (Δ+◎, large)

An exit pressure member (a part of the toner-paper fixing+all of paper releasing): pressure loading (Δ+○, middle)

From this, three (3) pieces of the pressure members are adopted for obtaining the high-speed fixing, the short warming-up time, and the oil-less toner fixing, and wherein the second pressure member from the paper entering side is made to be larger in the pressure loading, than those of first and third ones.

Explanation will be given on the pressure conditions (=the surface pressure*the nip width) for the respective pressure members 8*a*, 8*b* and 8*c*, from two (2) viewpoints of (A) grab and (B) paper releasing.

(A) Relationship of the pressure condition of the each pressure member onto the grab (i.e., fixing property).

Explanation will be made about the pressure condition for achieving the fixing, by referring to FIGS. 5 and 6. In FIGS. 5 and 6, the pressure conditions are plotted at the point where the fixing can be achieved at the equal temperature (140° C.), while the pressure conditions of two (2) of the three (3) pressure members are fixed but the pressure condition of the other one is changed, upon the basis of the condition that the fixing can be obtained under the temperature 140° C. of the three (3) pieces of the pressure members, as shown in FIG. 1. FIG. 5 shows a result of the case of a low fixing velocity (100 mm/sec), and FIG. 6 that at a high fixing velocity (200 mm/sec).

From this, a result can be obtained that the pressure conditions, in particular, the temperature for obtaining equal fixing, are fluctuated for the exit pressure member, and that the surface pressure can be low, which should be important for the fixing, at the low fixing velocity (100 mm/sec). This indicates a possibility that the exit pressure member may not be loaded with pressure (i.e., only two (2) pressure members are enough) if setting up the pressure condition of the central pressure member appropriately.

On the other hand, at the high fixing velocity (200 mm/sec), it is possible to drawn a line of equal fixing temperature also for the exit pressure member, therefore it indicates that three (3) pieces of the pressure members are necessary.

From the present result, those three (3) pressure members are in the relationship, (center)>(inlet), (exit), in particular, in the surface pressures thereof.

What can be said further from FIGS. 5 and 6 is that, (inlet)>(center)>(exit), in particular, in the distribution of the nip width, judging from the fact that (inlet)>(center)>(exist) in the absolute value of an inclination of the (surface pressure)/(nip width) in the figure. Accordingly, a preferable fixing can be achieved with the less surface pressure, by bringing the nip widths of the respective pressure members into (inlet)>(center)>(exit).

(B) Relationship of pressure conditions by the respective pressure members onto the paper releasing In the fixing apparatus, since the form of the nip portion has a convex shape on the fixing roller side thereof, when a paper passes through, the paper coming out from a nip exist is likely to be wound around on a side of the fixing roller 2. For such the behavior of the paper likely to be wound around, it is effective to rise up the pressure of the exit pressure member 8*c*, so as to deform the rubber layer 5 of the fixing roller 2, thereby causing a concave shape in the form of the nip exit, locally at the side of the fixing roller, and explanation will be made on the condition of releasing of a paper in relation with the pressure of the exit pressure member, by referring to FIG. 7.

FIG. 7 shows a test result of the case where a guide 30 is mounted for the purpose of pick-up of a paper coming out from the nip and also for removing curling on a thick paper. In FIG. 7, (a) edge bending means a phenomenon that a paper is discharged while being picked up by means of the guide, though a part of the paper enters into a gap between the guide 30 and the fixing roller, since the paper comes out but is likely to be wound around, and (b) winding (or jam) means the condition where the paper is not discharged since it enters into the gap between guide 30 and the fixing roller 2. Either one of those phenomena will occur when the exit pressure member is in appropriate in the pressure condition thereof.

From FIG. 7, no problem occurs under 0.1 (MPa) for a normal paper (having the basis weight around 80 g/m$^2$), however 0.2 (MPa) is necessary for a thin paper (having the basis weight around 60 g/m$^2$, and being low in the flexibility thereof). For releasing of paper, the contribution of the pressure of the exit pressure member is large.

Upon the basis of the acknowledgement mentioned in the above, it is possible to achieve the high-speed fixing at 200 mm/sec and at the fixing temperature 140° C., by bringing the pressure distribution of the fixing apparatus, in particular, at the nip portion, to be shown in FIG. 8. Summing up the conditions, they are as follows:

Having peaks at three (3) portions corresponding to those where the pressure members 8*a*, 8*b* and 8*c* are in contact with.

(1) the nip width: the inlet pressure member (for example, 4.5 mm)>the central pressure member (for example, 3.5 mm)>the exit pressure member (for example, 2 mm);

(2) the surface pressure: the central pressure member (for example, 0.5 MPa)>the exit pressure member (for example, 0.22 MPa), the inlet pressure member (for example, 0.2 MPa);

(3) the pressure loading (corresponding to the product between the nip width and the surface pressure): the central pressure member>the inlet pressure member, the exit pressure member, in the order thereof. Also by taking the result of FIG. 6 into the consideration, the detailed regions of preferable pressure conditions are as below:

(a) the inlet pressure member: (1) the nip width: from 3 (mm) to 7 (mm), and (2) the surface pressure: from 0.05 (MPa) to 0.2 (MPa);

(b) the central pressure member: (1) the nip width: from 2 (mm) to 4 (mm), and (2) the surface pressure: from 0.2 (MPa) to 0.5 (MPa); and (c) the exit pressure member: (1) the nip width: from 1 (mm) to 3 (mm), and (2) the surface pressure: from 0.1 (MPa) to 0.3 (MPa).

In this manner, since the pressure conditions can be obtained, respectively, which are required for the inlet pressure member, the central pressure member, and the exit pressure member, therefore it is preferable that each of the pressure members 8*a*, 8*b* and 8*c* is applied with pressure by means of independent pressure applying means 9*a*, 9*b* and 9*c*, respectively.

As for the belt pressure member 8, there can be considered application of a rotary type pressure member (a pressure roller), pushing a roller onto the reverse surface of the belt, and also a non-rotary type pressure member (a pressure pad), which pushes a plane portion onto the reverse surface of the belt.

From this, differences can be seen between the pressure roller and the pressure pad from the viewpoints mentioned below:

(1) of ensuring the nip width: the pressure pad is advantageous;

(2) of applying the surface pressure: equal to; and (3) of belt rotation load: the pressure roller is advantageous.

From this, it is preferable that, as the inlet pressure member, the pressure pad is preferable because of the importance of ensuring the nip width; as the central pressure member, the pressure roller or the pressure pad can be adopted, since the requirements are made on both the surface pressure and the nip width; and as the exit pressure member, the pressure roller or the pressure pad can be adopted, since the requirement is made, not on the nip width but only on the surface pressure.

However, since disposition of the pressure roller in two (2) pieces thereof, adjusting with each other, brings about a large-sizing in the structure thereof, therefore it is undesirable to dispose those pressure rollers neighboring with each other. And, by taking this into the consideration, the pressure member 8 shown in FIG. 1 should be built up with any one of the constructions, which will be shown below:

(1) the inlet pressure member: a pressure pad, the central pressure member: a pressure pad, and the exit pressure member: a pressure pad;

(2) the inlet pressure member: a pressure pad, the central pressure member: a pressure roller, and the exit pressure member: a pressure pad; and (3) the inlet pressure member: a pressure pad, the central pressure member: a pressure pad, and the exit pressure member: a pressure roller.

With adoption of such the structure, it is possible to achieve the pressure condition, which was mentioned in the present embodiment, and thereby obtaining the high-speed fixing.

In order to shorten the warming-up time in the fixing apparatus, it is effective to lower the thermal capacity of the heating member, as well as, to make a heat radiation member from a heat insulating material. For lowering the thermal capacity of the heating member, it is also effective to make the core metal and the rubber of the fixing roller thin in the thickness thereof. For making the heat radiation member heat insulating, it is effective to provide a heat insulating elastic layer 12 on the surface of the pressure member 8. Though FIG. 1 shows an example, in which the heat insulating elastic layer 12 is provided only on the inlet pressure member 8*a*, however the present invention should not be restricted to this.

Figure 9:
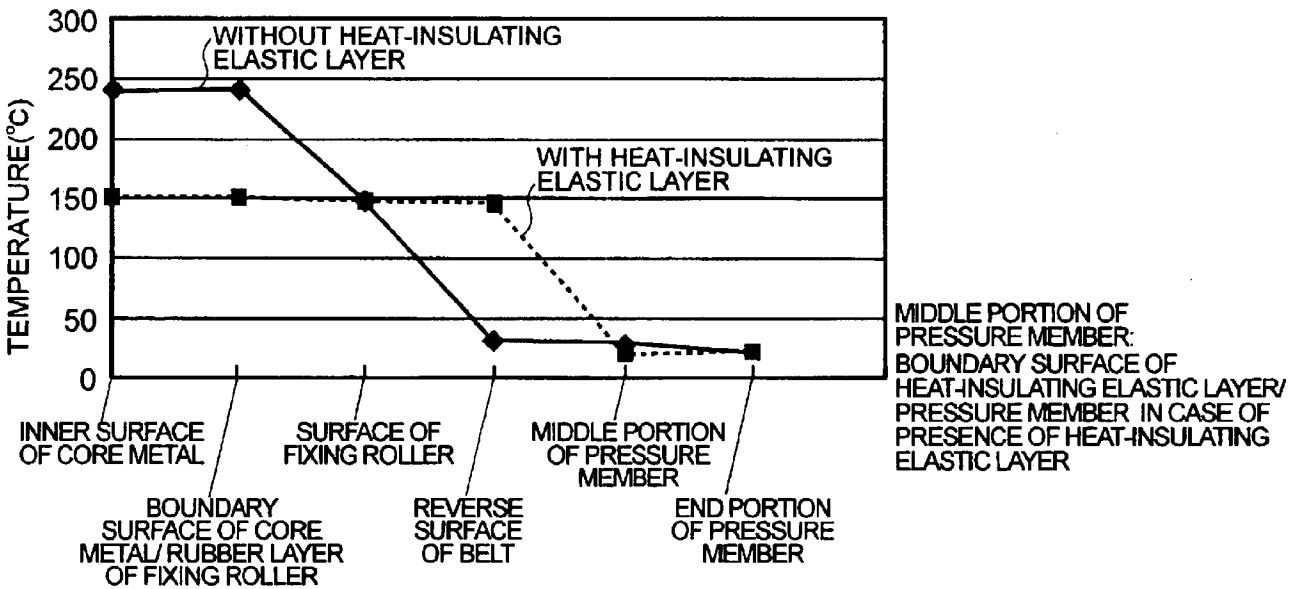
FIG. 9 is a graph for showing an example of calculation of temperature distribution, in particular, on the fixing portion of the fixing apparatus, according to one embodiment of the present invention.
Figure 10:
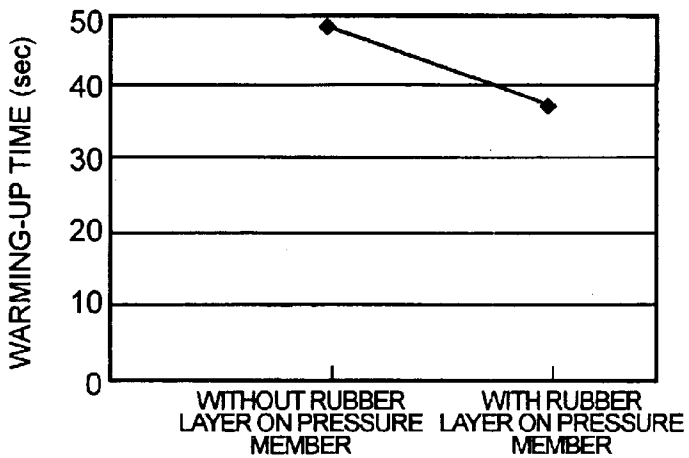
FIG. 10 is a graph for showing a warming-up time of the fixing apparatus, according to one embodiment of the present invention.

An example is shown in FIG. 9, for calculating out stable thermal conductivity when the surface of the fixing roller is at 150° C. and the edge of the pressure member at 20° C., upon the basis of thermal resistances. Though being rough calculation, there is produced a large thermal gradient within an inside of rubber of the fixing roller and also within an inside of the belt, when no such the heat insulating elastic layer 12 is provided on the surface of the pressure member. This is, since the rubber layer of the fixing roller, as well as the belt, has the large thermal resistance. On the other hand, in a case where a heat insulating elastic layer having the thermal resistance is provided on the surface of the pressure member, being larger than that of the rubber layer of the fixing roller and the belt, a large thermal gradient is generated in the heat insulating elastic layer of the pressure member, as indicated by a broken line in FIG. 9. With such the structure, since the temperature can be lowered down comparing to the case of providing no such the heat insulating elastic layer on the surface of the pressure member, even in an aspect how high temperature an inner surface temperature of the core metal should be raised up when heating the surface of the fixing roller to 150° C., therefore it is possible to make the warming-up time short.

warming-up times are shown in FIG. 10, in the cases where such the heat insulating elastic layer 12 is provided and not provided, on the inlet pressure member, which is made of silicon rubber. The warming-up time is lowered down, with the provision of the heat insulating elastic layer.

From a view point of the grab (i.e., the fixing property), it is advantageous to provide the heat insulating elastic layer 12 on the inlet pressure member 8*a*. As was explained by referring to FIG. 6, in the embodiment mentioned above, since the inlet pressure member has a large sensitivity to the fixing temperature at the nip width, providing of the heat insulating elastic layer 12 on the surface thereof enables to obtain expansion of the nip width due to the elastic deformation thereof, therefore it is also advantageous with respect to that aspect. And, with the central pressure member 8*b* and the exist pressure member 8*c*, preferably, they are constructed without provision of such the heat insulating elastic layer thereon, since they have large sensitivities with respect to the fixing temperature on the surface pressure.

With materials, for example, silicon rubber is preferable, as to be the heat insulating elastic layer formed on the pressure member, which has a low heat conductivity of which is low. And, it is preferable to made up the pressure member, on which no such the heat insulating elastic layer is provided, from aluminum, iron, etc.

Next, explanation will be given on means for reducing driving torque for driving the fixing apparatus.

Figure 11:
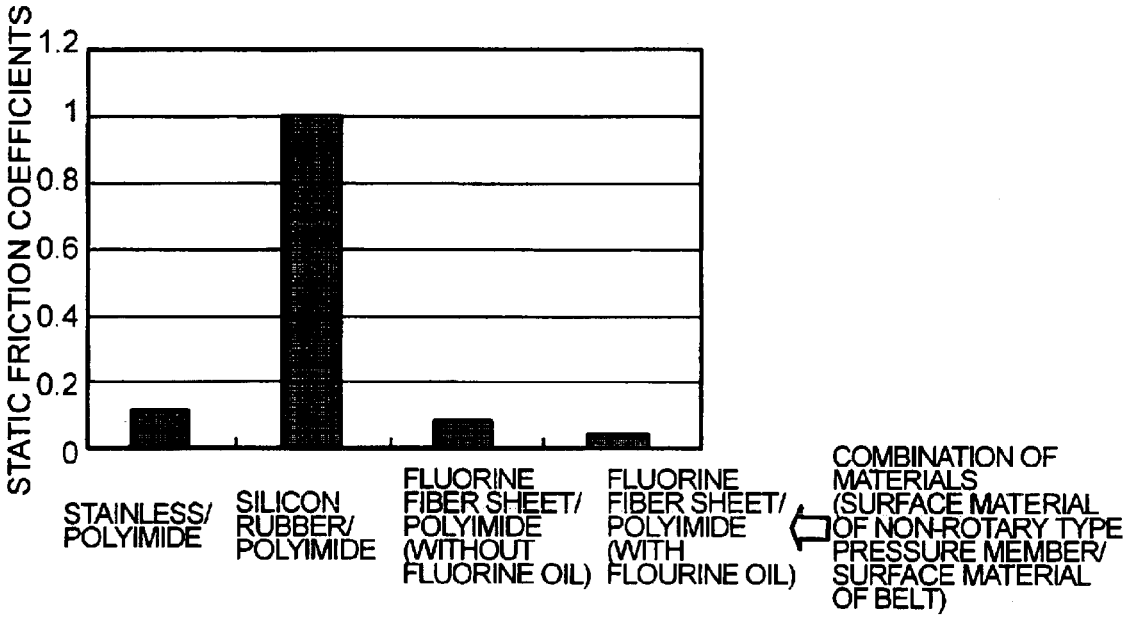
FIG. 11 is a graph for showing static friction coefficients between a surface material of non-rotary type pressure member and a reverse surface material of a belt in the fixing apparatus, according to one embodiment of the present invention.

Explanation will be made on the static friction coefficient between the surface material of the non-rotary type pressure member and the reverse surface material of the belt, when they are in contact with each other under pressure, by referring to FIG. 11. Herein, a result will be shown on measurement, being made on an target, in which a polyimide is used as the material of the belt, having high heat resistance.

(1) in a case that the surface material of the non-rotary type pressure member is of stainless: 0.1;

(2) in a case that the surface material of the non-rotary type pressure member is of silicon rubber: 1.0;

(3) in a case that the surface material of the non-rotary type pressure member is a fluorine resin fiber sheet (the lubricant (fluorine oil) no): 0.08; and (4) in a case that the surface material of the non-rotary type pressure member is a fluorine resin fiber sheet (the lubricant (fluorine oil) yes)e: 0.03.

From this, it comes up to be clear that the friction coefficient can be lowered down to (1) in the case without the lubricant, but with provision of the fluorine fiber sheet on the silicon rubber layer, as the surface material of the non-rotary type pressure member. And, further with provision of the lubricant, it is also clear that the friction coefficient can be lowered, remarkably. As such the lubricant, it is preferable to use fluorine oil showing a high affinity with the fluorine fiber.

Figure 12:
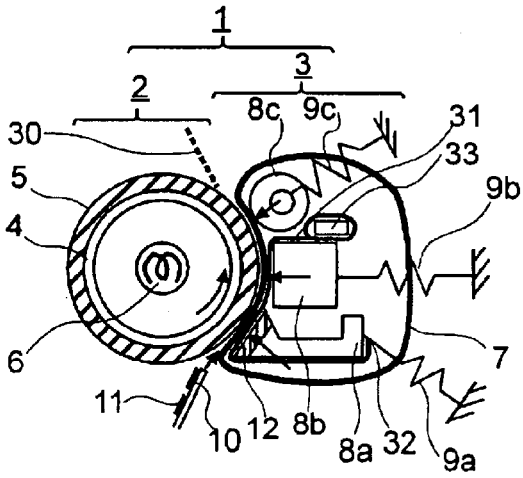
FIG. 12 is a view for showing the structure of the fixing apparatus, according to one embodiment of the present invention.

Then, as shown in FIG. 12, it is desirable that a sheet-like member 31 is provided on the surface of the non-rotary pressure member (such as, the inlet pad 8*a*, the central pad 8*b*), which is made of the fluorine fibers. The sheet-like member 31 is fixed at one end 32 thereof (i.e., on an upstream side to the rotation direction of the fixing roller). With adopting such the structure, it will not come off when the fixing roller rotates, and thereby achieving the function as the low friction material between the rotating endless belt and the static pressure pad 8*a* and 8*b*, under the non-rotation condition thereof.

Figure 13:
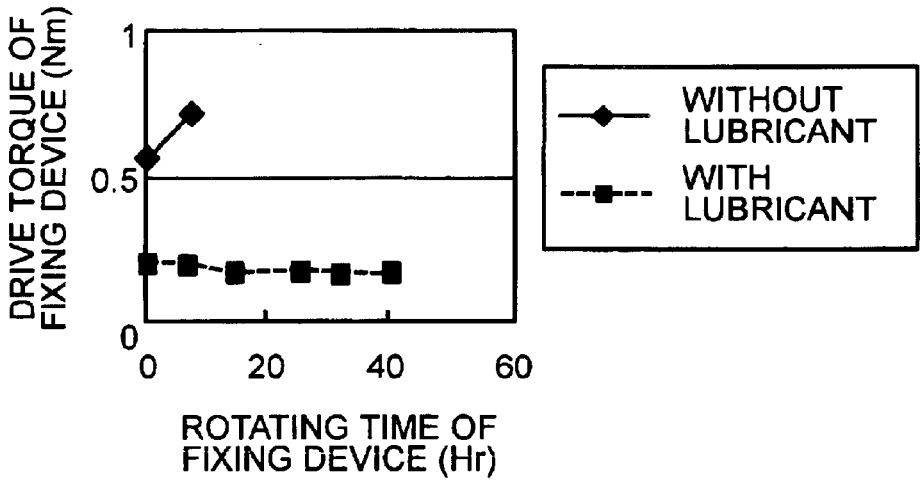
FIG. 13 is a graph for showing differences in driving torques, depending upon existence of lubricant in the fixing apparatus, according to one embodiment of the present invention.

FIG. 13 shows a relationship between the driving torque of the fixing apparatus and the rotation time of the fixing apparatus, in cases where the lubricant exists and not. From this, under the condition of no lubricant therein, an increase can be seen on the driving torque within a short time-period, on the contrary to that, with the lubricant, such the increase of the driving torque cannot be found even if rotating the fixing apparatus for a long time.

As was mentioned above, with using the lubricant together with the sheet material 31, it is possible to lower the driving torque of the fixing apparatus, and thereby reducing changes in the driving torque in spite of long-time rotation of the fixing apparatus.

For achieving an increase of the driving torque when rotating the fixing apparatus for further long time, with the structure of small leakage of the lubricant therefrom, it is desirable to provide a lubricant supply portion 33 with the sheet-like member 31.

Figure 14:
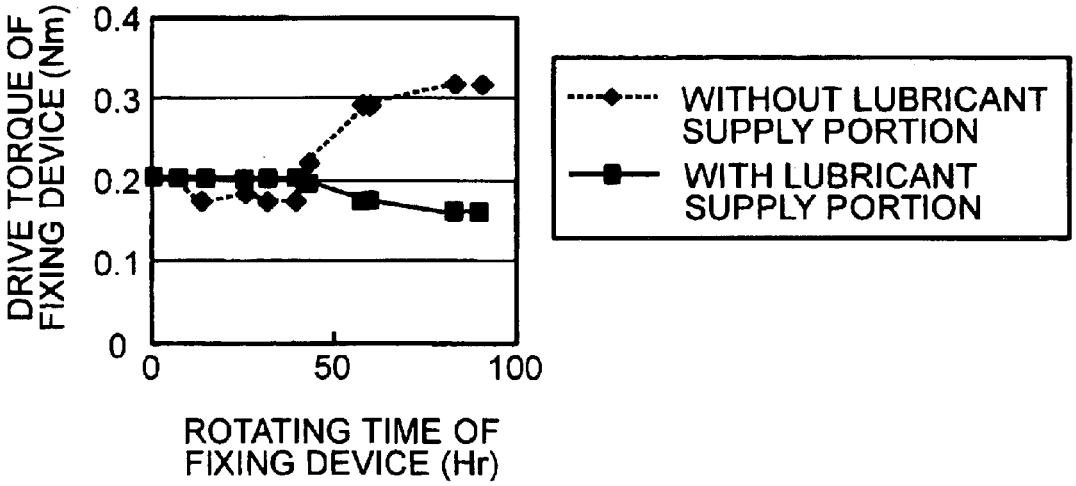
FIG. 14 is a graph for showing changes of the driving torque with time in the fixing apparatus, according to one embodiment of the present invention.

When rotating the fixing apparatus (with the sheet-like member 31 and the lubricant) for further long time, but without the lubricant supply portion 33, a characteristic can be seen that the driving torque rises up, as indicated by a broken line in FIG. 14. A reason of this can be considered, because the-lubricant comes down in the mass, which is held within the sheet-like member 31, as indicated by a broken line in FIG. 15. In the conventional belt fixing apparatus is already known the structure, in which the lubricant supply portion (i.e., being made up with a felt or the like) is so provided that it is in contact with an inner periphery surface of the belt. However, with such the structure, the lubricant supply portion is disposed, so as to be encroached into the belt, for obtaining the contact of the lubricant supply portion with the belt with certainty. For this reason, the lubricant supply portion is pushed through the belt, and therefore, there is a big problem that leakage of the lubricant is large in both ends in an axial direction thereof. According to the present embodiment, as was shown in FIG. 12, the lubricant supply portion 33 is provided in the structure, at a position where it does not contact with the inner peripheral surface of the belt, not a portion of the sheet-like member between the pressure member and the belt, and thereby allowing the lubricant supply portion 33 to contact with the sheet-like member 31. With this, the lubricant can move from the lubricant supply portion 33 into the sheet-like member 31 with an aid of diffusion in concentration. Accordingly, when the lubricant is low in the concentration thereof at the portion being put between the pressure members 8*a* and 8*b* and the belt 7, the lubricant moves from the lubricant supply portion 33 to that portion with an aid of the diffusion. Herein, the lubricant supply portion 33 is made of a heat-resistant fiber, such as, aramid fiber, for example, and has the structure of holding the fluorine oil therein.

Figure 15:
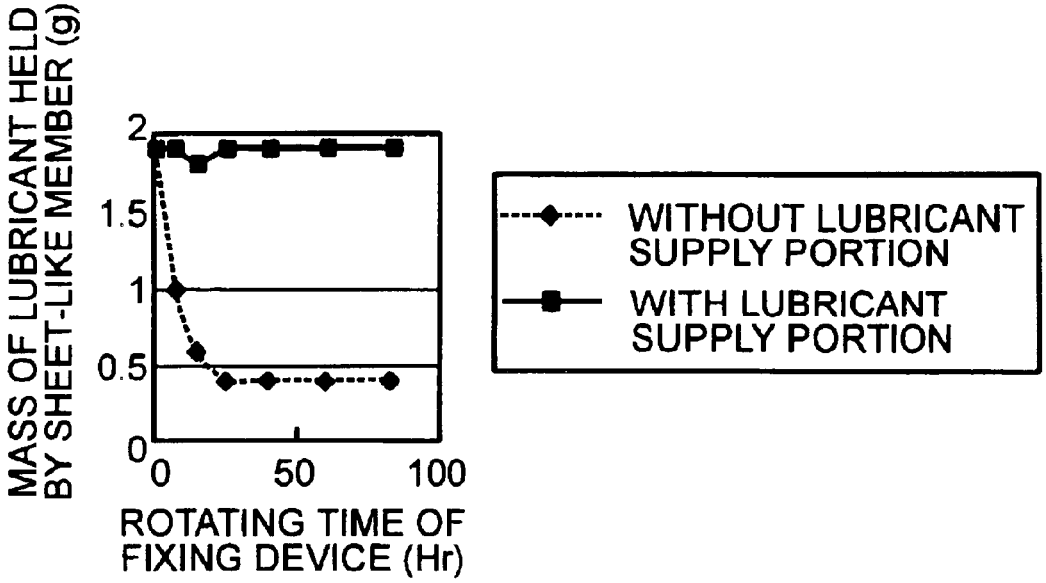
FIG. 15 is a graph for showing changes of mass of lubricating held within a sheet-like member in the fixing apparatus, according to one embodiment of the present invention.

With adoption of such the structure, the sheet-like member shows a change with time, as is indicated by a solid line shown in FIG. 15, in relation to the mass of the lubricant holding therein, i.e., the change can be made small, and also the change in the driving torque of the fixing apparatus can be made small, as is indicated by a solid line shown in FIG. 14.

Figure 16:
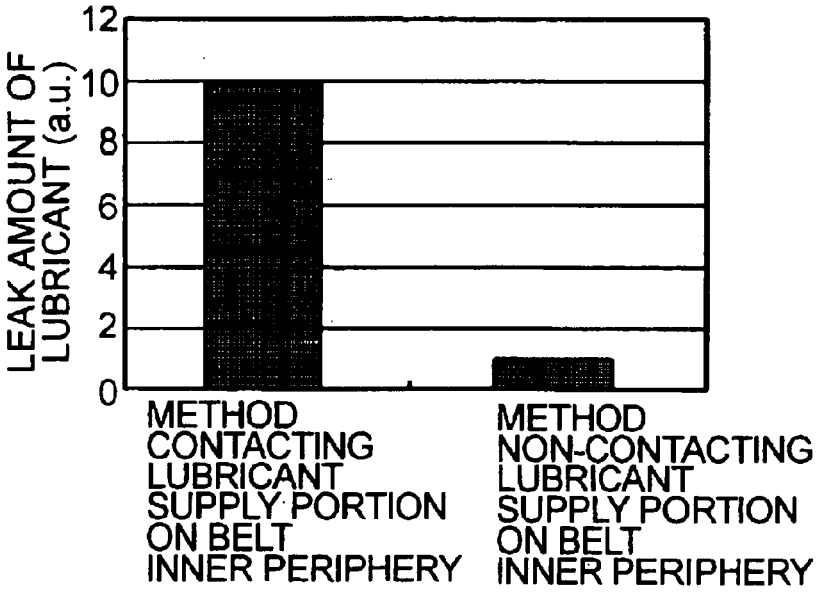
FIG. 16 is a graph for showing difference in an amount of leakage of the lubricant in the fixing apparatus.

Also, comparing the conventionally well-known structure, in which the lubricant supply portion (i.e., being made up with felt or the like) is provided so that it is in contact with the belt on the inner peripheral surface thereof, to the structure according to the present embodiment, in particular, in an amount of leakage of the lubricant when rotating for a predetermined time-period, a result can be obtained as shown in FIG. 16, and therefore it is possible to reduce the leakage amount of the lubricant, remarkably, by applying the structure according to the present embodiment.

Further, it is also possible to change the pressure member 8*c* to be the non-rotary type pressure member, and wherein the sheet-like member 31 can be provided, riding over a plural number of the non-rotary type pressure members, or separating by each of the non-rotary type pressure members. Also, the lubricant supply portion 33 may be provided by one (1) in common with the plural number of non-rotary type pressure members, or may be provided separately for each of the non-rotary type pressure members.

As was mentioned in the above, providing the sheet-like member made of fluorine fiber (such as, texture made of non-porous fluorine resin, for example) between the non-rotary type pressure member and the belt, and/or providing the lubricant supply member made of the sheet-like member at the position where no contact is made with the belt enable the structure, in which the lubricant is supplied with an aid of diffusion thereof. With such the structure, the lubricant diffusively speeds out due to the concentration gradient within an inside of the fluorine resin sheet, and therefore, it is possible to obtain the structure, in which the lubricant is compensated for when the concentration of the lubricant comes down at the portion located between the pressure unit and the belt. For this reason, comparing to the structure, in which the lubricant supply member is pushed onto the belt, it is possible to reduce the leakage of the lubricant at the end portion, remarkably. With this, it is possible to make the time-change of the driving torque in the fixing apparatus small, and achieve the structure of reducing the leakage of lubricant, as well.

Figure 17:
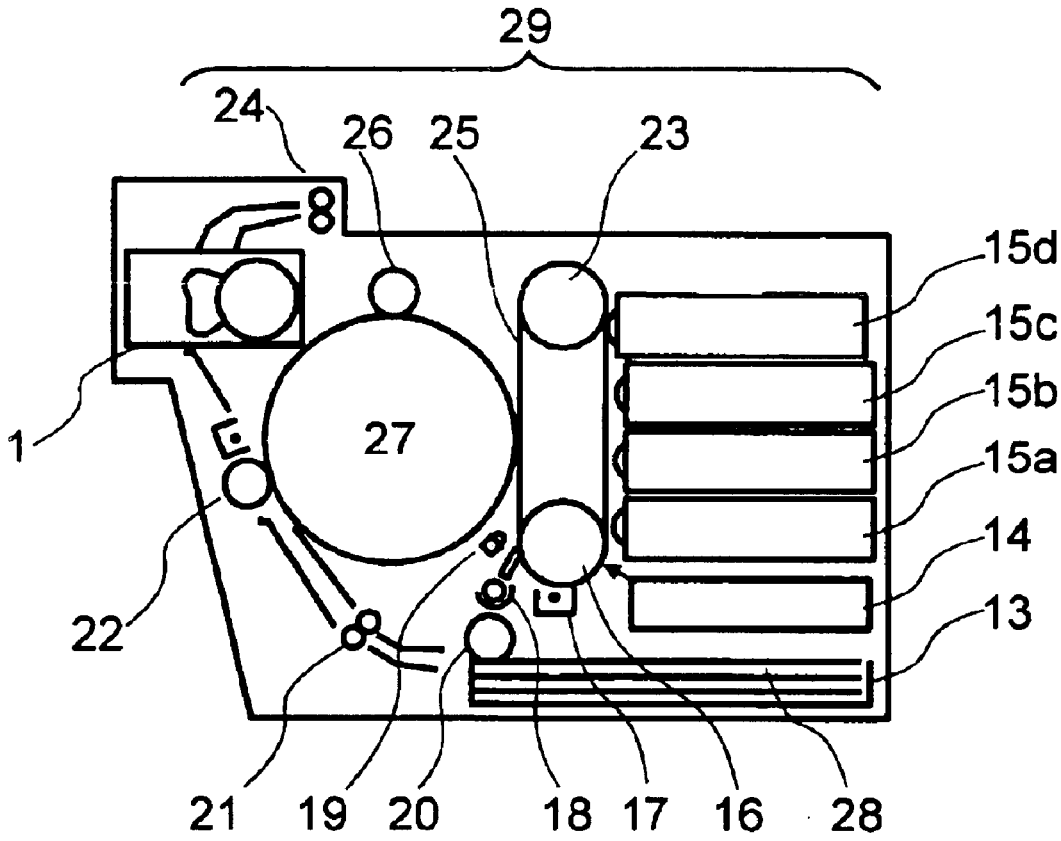
FIG. 17 is a view for showing the structure of an image forming and recording apparatus, according to one embodiment of the present invention.

Next, explanation will be made on the structure of an image forming and recording apparatus having the fixing apparatus therein, according to the present invention, by referring to FIG. 17.

The image forming and recording apparatus comprises: a photosensitive belt 25, being suspended in the vertical direction by means of a driving roller 23 and a driven roller 16, which combines function of a tension roller for applying tension onto a belt, and rotating at a constant speed in a direction of an arrow; an intermediate transcription body disposed so that it contact with the photosensitive belt 25; a charging device 17 for charging the surface of the photosensitive belt 25 in uniform; an exposing device 14 for exposing the uniformly electrified surface of the photosensitive belt 25, so as to form an electrostatic image on said the surface; four (4) sets of developers 15*a*, 15*b*, 15*c* and 15*d*, being disposed so that they are in contact with the horizontal plane of the photosensitive belt 25, and for developing the electrostatic image to form a toner image; a paper feeder roller 20 for feeding or supplying a recording medium from a cassette 13, storing the recording medium, such as paper, etc., therein; a resist roller 21 for adjusting a position of the recording medium supplied from the cassette 13; a transcription roller 22 for transcribing the toner image on the recording medium; a fixing apparatus 1; a paper discharging portion where the recording medium fixed with the image thereon is discharged into an outside of a machine; an erase lamp 19 for removing electric charge remaining on the surface of the photosensitive belt 25; a blade 18 for removing the remaining toner thereon; and a cleaner 26 for removing the remaining toner on the surface of the intermediate transcription body 27 after the transcription.

Herein, the driving roller 23 and the driven roller 16 can be disposed upside down. Also, the intermediate transcription body 27 may be made up with a drum or a belt. In a case of building up with the belt, rollers are provided for applying tension on the belt on each inner surface thereof, such as a contact portion with the photosensitive body 25 and a contact portion with the transcription roller 22.

Next, explanation will be made on a forming method of a color image, according to the present apparatus.

After turn-on of the electric power, when a print signal is sent from an information processing apparatus not shown in the figure to a printer main body being under print waiting condition, a laser beam is irradiated from the exposing device 14 on the photosensitive bet 25 charged or electrified in uniform by means of the charger 17, at the positions corresponding to the toner image, thereby forming the electrostatic image on the photosensitive belt 25.

First, the electrostatic image is formed on the photosensitive belt 25, corresponding to the toner image of cyan color by means of the exposing device 14, and is developed by means of a cyan color developer 15*d*, thereby obtaining a toner image. Therein, a reference numeral 15*d* indicates the developer which uses cyan color toner therein, 15*c* the developer which uses magenta color toner therein, 15*b* the developer which uses yellow color toner therein, and 15*a* the developer which uses black color toner therein, and wherein the function of development for each developer can be given or lost by controlling a bias voltage thereof. The toner image formed on the photosensitive belt 25 is transcribed on a surface of the intermediate transcription body 27 at the contact potion thereof with the intermediate transcription body 27, and it is maintained on the said surface.

On the other hand in the structure mentioned above, upon the surface of the photosensitive belt 25 after transcription of the toner image, the residual electric charge thereon is removed by means of the eraser lamp 19, and thereafter the toner remaining thereon without being transcribed is removed by means of the blade 18.

After finishing steps for turning the surface of the photosensitive belt 25 back to the initial condition, as a next color, the toner image of magenta color is formed on the surface of the photosensitive belt 25 in the similar manner, and it is transcribed on the toner image of the above-mentioned cyan color image, which is kept on the surface of the intermediate transcription body 27, by fitting thereon, thereby holding them on the intermediate transcription body 27.

Repeating the similar steps for the yellow color and the black color, the toner images of the four (4) colors are fitted thereto on the intermediate transcription body 27, and at the same time, are held on the said surface thereof.

For the purpose of transcribing the toner images of four (4) colors formed on the surface of the intermediate transcription body 27 onto the recording medium 28, the recording medium 28 received within the cassette 13 is separated by a unit of one (1) piece, by rotating the paper feed roller 20, and after being transferred up to the resist roller 21, so as to made compensation on an inclination thereof, then it is stopped. Then, the resist roller 21 is started to rotate at such timing that it adjusts to the toner image formed on the intermediate transcription body. When the tip of the recording medium 28 to be transferred is in contact with the intermediate transcription body 27, at the same time, the transcription roller 22 is pushed onto from the rear surface of the recording medium 28, and thereby transcribing the toner images of four (4) colors formed on the surface of the intermediate transcription body 27 onto the recording medium 28, at the same time, in an electrostatic manner. The toner image of four (4) color, which is built up on the recording medium 28 in this manner passes through between the fixing roller and the pressure roller of the fixing apparatus 1, to be fixed thereon, and it is discharged into the paper discharging portion 24 of the printer 29, thereby completing a series of processes for printing images.

With provision of the fixing apparatus, having such the structure as was mentioned, in such the image forming and recording apparatus, it is possible to accomplish the high-speed fixing, the short warming-up time, and the fixing of oil-less toner.

As was fully explained in the above, with the image forming and recording apparatus, according to the present invention, applying the three (3)-divided belt pressure members therein, and wherein the pressure thereof is made the maximum at the second one from an inlet for enter into the nip, it is possible to take times for heating toner and applying pressure long, thereby achieving the high-speed fixing thereof.

With provision of the sheet-like member between the non-rotary type pressure member and the endless belt, so as to obtain a low friction, and further with applying the lubricant, so as to further lower the friction, it is possible to reduce the time-change on the driving torque of the fixing apparatus. Moreover, with provision of the lubricant supply portion at a portion on the sheet-like member, which is located at non-pressure applied portion between the non-rotary type pressure member and the endless belt, and is also a non-contact portion between an inner peripheral surface of the belt, it is possible to achieve the further reduction of the time-change on the driving torque of the fixing apparatus, but with the less leakage of the lubricant.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. An image forming and recording apparatus, having a fixing apparatus for fixing unfixed toner image on a recording medium, wherein said fixing apparatus comprises:

a fixing roller integrating a heater therein;

an endless belt wound around said fixing roller; and three pressure members for pressing said endless belt onto said fixing roller;

wherein a pressure member located nearest to a side of entry of paper among said three pressure members is made up with a non-rotary type pressure member, and other two pressure members are made up with either one of a rotary type pressure member and the non-rotary type pressure member.

2. The image forming and recording apparatus, as defined in claim 1, wherein pressure, being applied onto said fixing roller through said endless belt, has three peaks, and pressure of a second peak from the side of entry of paper is larger than those of other two peaks, among said three peaks.

3. The image forming and recording apparatus, as defined in claim 1, wherein contact widths of said three pressure members, where they are pressing on said fixing roller through said endless belt, are in an order of: the pressure member of the paper entry side, a central pressure member, and a pressure member of a paper exit side, in sizes thereof.

4. The image forming and recording apparatus, as defined in the claim 3 wherein surface pressures of said three pressure members, where they are pressing on said fixing roller through said endless belt, are: from 0.05 (MPa) to 0.2 (MPa) at the pressure member of the paper entry side, from 0.2 (MPa) to 0.50 (MPa) at the central pressure member, and from 0.1 (MPa) to 0.3 (MPa) at the pressure member of the paper exit side, in amplitude thereof.

5. The image forming and recording apparatus, as defined in claim 1, wherein a heat-insulating layer is formed on a surface of the pressure members.

6. The image forming and recording apparatus, as defined in claim 1, wherein sheet-like member is inserted between said non-rotary pressure member and said endless belt, whereby said sheet-like member holds lubricant therein.

7. The image forming and recording apparatus, as defined in the claim 6 wherein said sheet-like member is made of fluorine fiber, and said lubricant is fluorine oil.

8. The image forming and recording apparatus, as defined in the claim 6, wherein a lubricant supply portion is provided at a portion of said sheet-like member, other than where said sheet-like member is put and pressed between said non-rotary type pressure member and said endless belt, whereby said lubricant supply portion has no contact with an inner peripheral surface of said belt.

9. The image forming and recording apparatus, as defined in any one of claims 1, 2 and 3 to 8 further comprising a single intermediate transcription body, on which are superimposed respective color toner images formed on a photosensitive body, and wherein a toner is used as a medium for manifesting electrostatic images, to be used in images forming, said toner being able to ensure a releasing property from said fixing roller without supplying a liquid releasing agent to said fixing roller in said fixing apparatus.

10. The image forming and recording apparatus, as defined in claim 1, wherein a second one from the side entry of paper is made maximum in pressure loading among said three pressure members.

* * * * *